United States Patent [19]

Weidler

[11] 4,273,474

[45] Jun. 16, 1981

[54] GROUTING OF OFFSHORE JACKETS TO DISTRIBUTE FORCES AMONG THE ANCHORING PILES

[75] Inventor: Jay B. Weidler, Houston, Tex.

[73] Assignee: Brown & Root, Inc., Houston, Tex.

[21] Appl. No.: 38,272

[22] Filed: May 11, 1979

[51] Int. Cl.[3] ..... E02B 17/00

[52] U.S. Cl. ..... 405/225; 405/227

[58] Field of Search ..... 405/195, 208, 222, 224, 405/225, 226, 227

[56] References Cited

U.S. PATENT DOCUMENTS

| | | | |
|---|---|---|---|
| 2,429,952 | 10/1947 | Willey | 405/227 |
| 3,114,245 | 12/1963 | Jennings, Jr. et al. | 405/244 |
| 3,533,241 | 10/1970 | Bowerman et al. | 405/225 |
| 3,638,436 | 2/1972 | Pogonowski | 405/227 |
| 3,823,564 | 7/1974 | Crout et al. | 405/224 X |
| 3,967,456 | 7/1976 | Stone | 405/225 |

*Primary Examiner*—David H. Corbin

*Attorney, Agent, or Firm*—Kenway & Jenney

[57] ABSTRACT

An offshore jacket is provided which comprises a plurality of main hollow pile sleeves and a plurality of secondary hollow pile sleeves of shorter height than the main sleeves and connected thereto by framing. A plurality of main piles and secondary piles are disposed within the main sleeves and secondary sleeves, respectively, and project downwardly therebeyond into the seabed. The main and secondary piles are connected to their respective main and secondary sleeves by grout disposed within an annulus between the sleeve and the pile, so that the pile resists axial forces. The grout within the secondary piles extends to the seabed. The grout within at least some of the main sleeves terminates above the seabed to decrease the axial spring value of the associated piles and thereby increase the proportion of the axial forces which are borne by the secondary piles. Also provided is an offshore jacket which does not employ secondary sleeves and piles; the lower level of grout within some of the sleeves is disposed above the level of grout within others of the sleeves located closer to a central axis of the jacket to decrease the axial spring values of the former piles and thereby more uniformly distribute the axial forces among the piles.

12 Claims, 5 Drawing Figures

GROUTING OF OFFSHORE JACKETS TO DISTRIBUTE FORCES AMONG THE ANCHORING PILES

BACKGROUND AND OBJECTS OF THE INVENTION

The present invention relates to the subsea anchoring of offshore jacket structures and, more particularly, to the grouting of jacket legs to a seabed.

Offshore structures of the type utilized in the drilling of oil or gas wells may comprise a jacket which is to be installed upon the seabed and a platform which is to be supported on the jacket above the water surface. Generally, the jacket is fabricated at a land-based facility, then towed on its side in a floating condition to an offshore work site and thereafter erected within the water and lowered onto the seabed. The jacket may comprise a plurality of legs or sleeves which rest on the waterbed and project upwardly to the water surface to carry a platform. The jacket sleeves are anchored to the seabed by means of piles which are driven through and beyond the pile sleeves and into the seabed. Apparatus of this type is disclosed, for example, in U.S. Pat. No. 3,823,564, issued to Crout et al on July 16, 1974 and assigned to the assignee of this invention. The disclosure of that patent is incorporated herein by reference as if set forth at length.

To permanently secure the piles in place within the sleeves, grout is introduced into the annulus formed between the outer face of each pile and an inner wall of its associated sleeve. The grout extends essentially the entire height of the annulus and somewhat below the mudline of the seabed.

In some instances the jacket is anchored solely by piles driven through the main jacket legs or sleeves, while in other instances secondary pile sleeves, or skirt sleeves, are utilized which are of relatively short height and are attached by framing to lower ends of the main sleeves. The secondary pile sleeves can be distributed around the baase of the jacket or arranged in clusters.

Once anchored, the jacket is subject to wave and current action which imposes considerable forces on the main jacket sleeves. Axial forces are transmitted from the main sleeves to the main piles via the grout connection. In cases where skirt piles are employed, it is intended that an appreciable portion of such loads be transmitted to the skirt piles via framing interconnecting the main and skirt sleeves to distribute the loads more evenly. It has been found in practice, however, that such loading may not be distributed in the most effective manner due to a certain degree of inherent flexibility in the framing which tends to restrict to transmission of forces to the secondary sleeves. As a result, the main piles are required to resist a greater proportion of the loading than is desired.

It has also been found that, whether or not skirt piles are employed, there may occur an uneven distribution of loads among the main jacket sleeves. That is, the piles of the main jacket sleeves located farther from the central axis of the jacket base are likely to bear a greater proportion of the loading than the piles of main jacket sleeves located closer to such central axis.

From the foregoing, it will be appreciated that prudence has heretofore dictated that at least some of the main sleeves and piles have had to be made larger than desired in order to compensate for the uneven distribution of loading among the various anchoring piles. This has resulted in added costs and other complications.

It is, therefore, an object of the present invention to minimize or obviate problems of the type discussed above.

It is another object of the present invention to provide novel anchoring arrangements and anchoring methods for an offshore jacket.

It is a further object of the invention to enable the distribution of forces in an offshore jacket to be more precisely controlled.

It is an additional object of the invention to create a more uniform distribution of loading among the anchoring piles of an offshore jacket.

It is another object of the invention to provide a jacket anchoring arrangement wherein the lower level of grout in at least some of the pile sleeves terminates at a level above the lower level of grout in other sleeves located closer to the central axis so that the axial spring value of the former piles is decreased whereby the distribution of forces among the piles is more uniform.

It is a further object of the invention to provide a jacket anchoring arrangement wherein skirt pile sleeves are connected to main pile sleeves and wherein the lower level of grout in at least some of the main pile sleeves terminates above the seabed to provide greater flexibility in the framing and thereby transfer a greater amount of loading to the secondary pile sleeves than would otherwise occur.

SUMMARY OF THE INVENTION

Some of those objects are achieved by the present invention involving an offshore jacket of the type comprising a plurality of main hollow pile sleeves and a plurality of secondary hollow pile sleeves of shorter height than the main sleeves and connected to the main sleeves by framing. All of the pile sleeves rest on the seabed and extend upwardly therefrom. A plurality of main piles and secondary piles are disposed within the main sleeves and secondary sleeves, respectively, and project downwardly therebeyond into the seabed. The main and secondary piles are connected to their respective main and secondary sleeves by grout disposed within an annulus between the sleeve and the pile, so that the pile resists axial forces. The grout within the secondary piles extends to the seabed. The grout within at least some of the main sleeves terminates above the seabed to decrease the axial spring value of the associated main piles and thereby increase the proportion of the axial forces which are borne by the secondary piles.

Objects of the invention can be achieved in an offshore jacket whether or not secondary sleeves and piles are employed. In that regard, the lower level of grout within some of the main sleeves terminates above the level of grout within others of the main sleeves located closer to a central axis of the jacket to increase the axial spring values of the former piles and thereby more uniformly distribute the axial forces among the piles.

The invention also relates to methods of grouting the pile sleeves of an offshore jacket to achieve the above-described results.

BRIEF DESCRIPTION OF THE DRAWINGS

The advantages of the present invention will become apparent from the following detailed description of preferred embodiments thereof in connection with the accompanying drawings in which like numerals designate like elements and in which.

DETAILED DESCRIPTION OF A PREFERRED EMBODIMENT OF THE INVENTION

The present invention will be described below in conjunction with two types of offshore jacket structures depicted in FIGS. 1 to 3, and 4 to 5, respectively.

Figure 1:
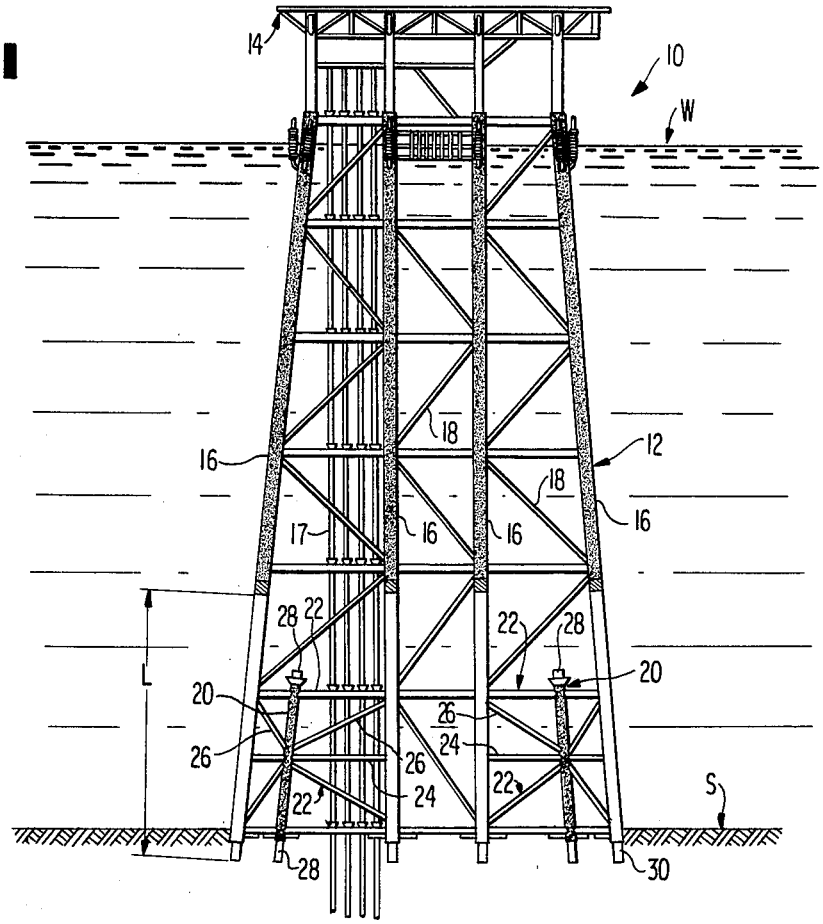
FIG. 1 is a side elevational view of an offshore jacket grouted in accordance with the present invention, with the pile sleeves thereof depicted in longitudinal section.

In FIG. 1, an offshore structure 10 is depicted which comprises a jacket 12 supported on a seabed and a work platform 14 mounted on the jacket above the water surface W. Extending from the platform are a series of oil or gas conductors 17 which project into the seabed.

The jacket comprises a plurality of main legs 16 in the form of hollow steel sleeves which extend between the water surface W and the seabed. The lower ends of the legs extend below the mudline of the seabed and the upper ends thereof project above the water surface W.

Steel reinforcement members 18 extend between the jacket legs in conventional fashion. Disposed at a lower end of the jacket are a plurality of secondary, or skirt, pile sleeves 20 which are in the form of hollow steel sleeves of significantly shorter height than the main pile sleeves 16. Lower ends of the skirt sleeves 20 rest on the seabed and the upper ends terminate well below the water surface W.

Figure 2:
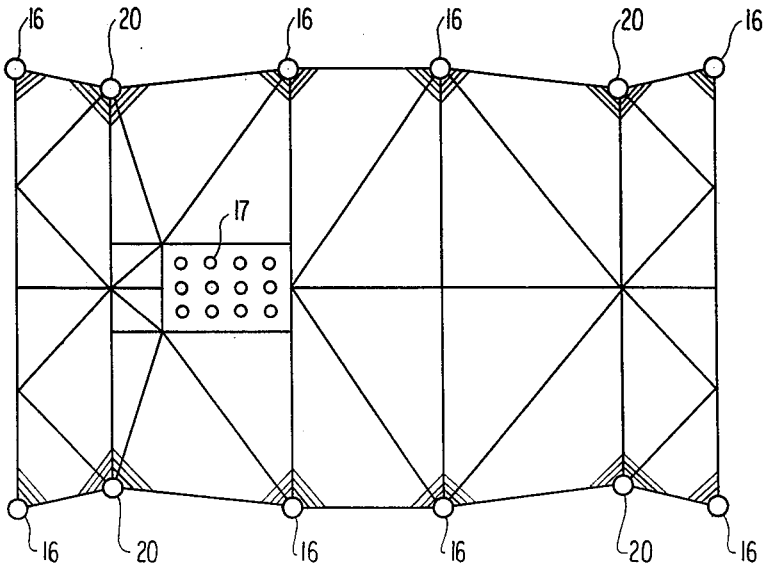
FIG. 2 is a schematic bottom view of the jacket depicting the arrangement of the pile sleeves.

The pattern formed by the main and skirt sleeves, 16, 20 is depicted schematically in FIG. 2. The skirt sleeves 20 can be arranged in various patterns at the base of the jacket 12, such as intermittently between the main legs 16 as depicted in FIGS. 1 and 2 or in clusters surrounding the main leg(s) as illustrated in U.S. Pat. No. 3,987,636 issued to Hruska et al on Oct. 26, 1976, and assigned to the assignee of this invention.

Figure 3:
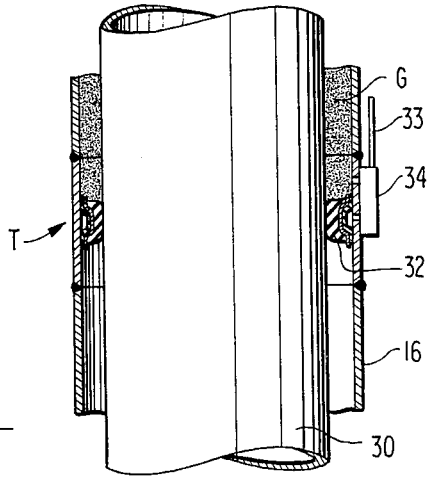
FIG. 3 is a fragmentary view, in longitudinal section, of a grout seal disposed within one of the main pile sleeves of the jacket illustrated in FIG. 1.

The skirt sleeves are connected to the main sleeves by steel framing 22 which, in the embodiment described in connection with FIGS. 1 to 3, comprises a plurality of horizontal and diagonal brace beams 24, 26 extending between adjacent main sleeves 16 and the respective skirt sleeves 20.

Such a jacket structure is conventional in the art. Installation of the jacket on the seabed is achieved by floating the jacket to the work site, and selectively flooding the jacket legs as described in greater detail in U.S. Pat. No. 3,823,564 issued to Crout et al on July 16, 1974 and assigned to the assignee of this invention. Thereafter, steel secondary piles 28 are driven through the skirt sleeves 20 to pin the jacket in place while main piles 30 are driven through the main sleeves 16 and into the seabed. Thereafter, grout is introduced into the annulus between the outer wall of each pile 28, 30 and the inner wall of the associated sleeve 16, 20. Upon hardening, the grout forms a permanent rigid connection between the sleeves and piles to anchor the jacket to the seabed.

Heretofore, the grouting has been applied to the main and skirt sleeves such that the grout extends downwardly essentially below the mudline of the seabed. In this manner, the pile and pile sleeve form a rigid unit along their entire common length.

It is the intent that axial loads which act along the main sleeves 16 are transmitted directly to the main piles 30 and indirectly to the skirt piles 28 via the framing 22 which interconnects the main and skirt sleeves 16, 20. In practice, however, it has been found that the framing exhibits a limited amount of flexibility which significantly restricts the amount of axial loading which is actually transmitted to the skirt piles. That is, some of the upward or downward axial force imposed on the main sleeves which would have otherwise been transferred to the skirt sleeves is merely absorbed by the flexibility in the framing. Hence, it is necessary for the main piles to bear a greater proportion of the loading than desired.

In accordance with the present invention, the grouting is accomplished such that at least some of the main piles are provided with an axial spring value which is sufficiently reduced to assure that a desired amount of loading is transferred to the skirt piles. To achieve this, the lower end of the grout G in at least some of the main pile sleeves terminates above the mudline to vary the axial spring value of the main piles in accordance with the expression.

$$Ka = AE/L$$

wherein:

Ka = axial spring value

A = cross-sectional area of main pile

E = Young's Modulus for the material of the main pile, and

L = ungrouted length of main pile, whereby the ungrouted portions of the main piles may compress or stretch axially by an appreciable amount enabling the main sleeve to be axially displaced sufficiently to flex the framing 22 appreciably more than would otherwise occur. Accordingly, a greater amount of axial force is transferred to the secondary piles than would have otherwise been transferred.

Termination of the lower end of the grouting layer above the mudline is accomplished by locating a conventional piline seal 30 (FIG. 3) at the level where such termination is desired. The piling seal can be of conventional design, comprising an inflatable annular packer-like element to which air is supplied under pressure via a conduit 33 and a valve 34. Under the action of compressed air, the seal element is pressed against the main pile 30 to form a barrier which limits the downward travel of grout.

The location of the lower terminus T of the grout G may vary, depending upon the amount of flexibility in the framing 22 which is to be compensated for or disposed by compressing or stretching of the ungrouted portions of the main piles. Typically, however, the grouting will terminate at a level above the framing 22.

Figure 4:
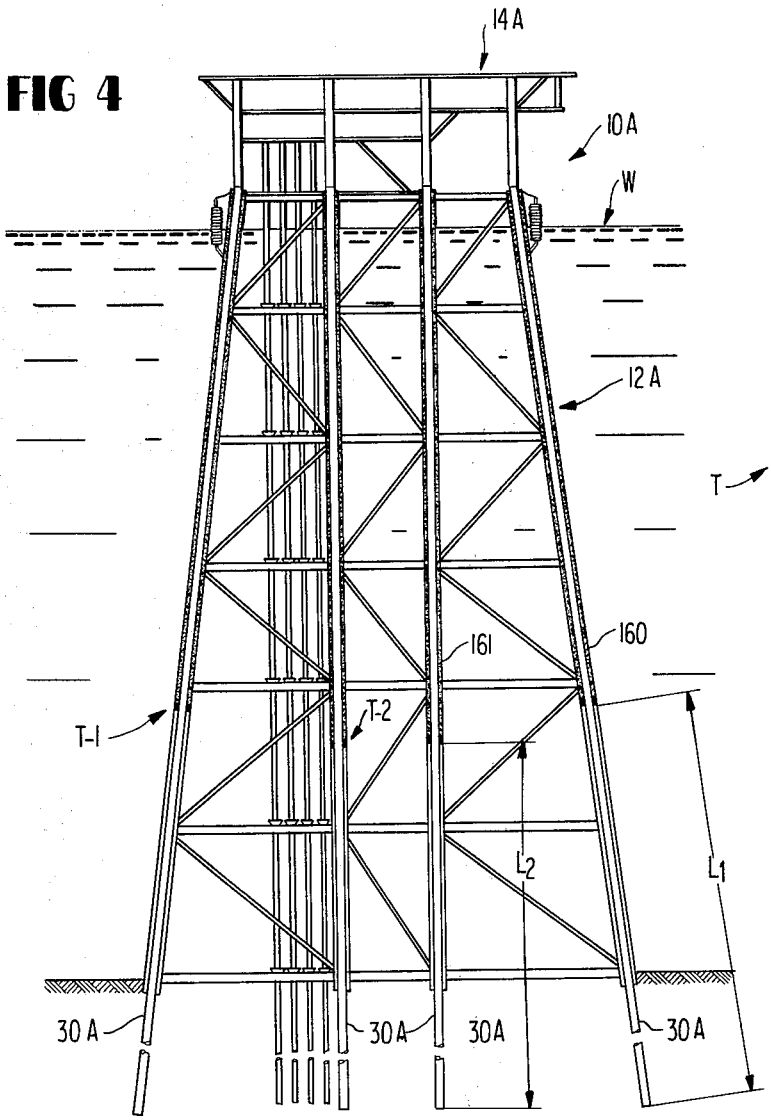
FIG. 4 is a view similar to FIG. 1 of another type of offshore jacket utilizing principles of the present invention.
Figure 5:
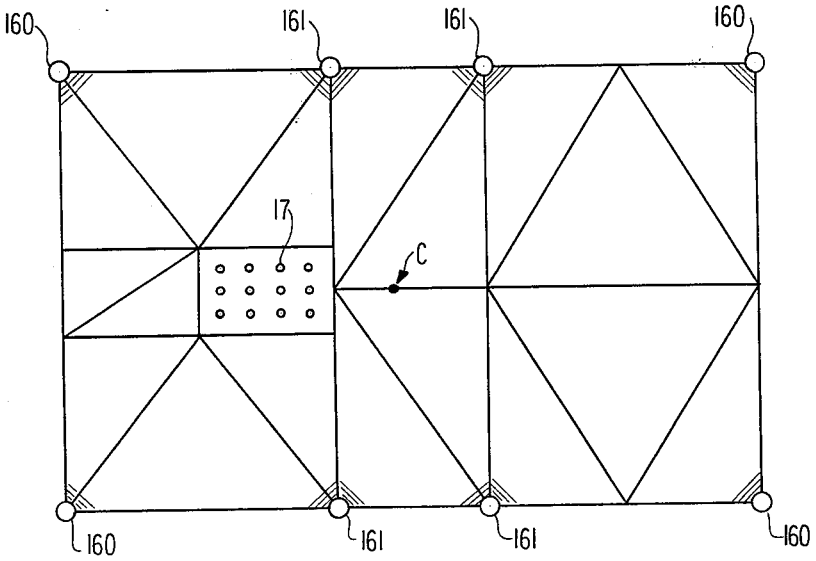
FIG. 5 is a view similar to FIG. 2 depicting the arrangement of pile sleeves on the jacket of FIG. 4.

The principles of the present invention are also useful in a jacket 12A in which no skirt piles are utilized, as depicted for example, in FIGS. 4 and 5. In this regard, it has been found that the loading which is borne by the main legs 15A in such a jacket varies from leg to leg, depending in great part on the proximity of the leg to the central axis C of the jacket base. Those legs which are located farther from the axis resist a greater portion of the loads than the legs which are closer to such axis. As a result, differently sized piles 30A must be utilized to assure that the loads are properly resisted. In accordance with the present invention, however, the axial spring values of the legs can be established by a selective positioning of the lower terminus levels of the grouting of the various legs to effect a more even distribution of loading. That is, the lower terminal levels T-1 of some of the outer legs 160 are situated higher than the levels T-2 of the inner legs 161 by predetermined distances. (The grout of the inner legs may extend all the way to the seabed, rather than terminating thereabove as shown.) Accordingly, the piles 30A of the outer legs have a longer ungrouted length L1 than that L2 of the inner legs and thus have a lower axial spring value. Therefore, the outer piles can stretch or compress farther than the inner piles, causing the inner piles to bear a larger amount of the axial loading than would otherwise occur. In that manner, the amount of loading borne by all of the piles 30A can be rendered more uniform.

SUMMARY OF MAJOR ADVANTAGES AND SCOPE OF THE INVENTION

It will be appreciated that the present invention enables the axial spring value of the jacket piles to be regulated to enable a more desired distribution of forces to be achieved. In cases where skirt piles are employed, the axial spring value of the main pile(s) is decreased to assure that ample loading is transferred to the associated skirt pile(s). In this fashion, the required size of the main pile can be minimized, thus achieving a considerable cost savings.

Moreover, regardless of whether skirt piles are employed, the relative axial spring values of the piles can be adjusted to compensate for the tendency of some piles to bear a higher proportion of the loads than other piles. As a result, piles of a uniform size can be employed which also results in worthwhile cost savings.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an offshore jacket of the type comprising a plurality of main hollow pile sleeves and a plurality of secondary hollow pile sleeves of shorter height than said main sleeves and connected to said main sleeves by framing, all of said pile sleeves resting on said seabed and extending upwardly therefrom; a plurality of main piles disposed within said main sleeves and projecting downwardly therebeyond into the seabed; a plurality of secondary piles disposed within said secondary sleeves and projecting downwardly therebeyond into said seabed, said main and secondary piles being connected to their respective main and secondary sleeves by grout disposed within an annulus between the sleeve and the pile, so that said piles resist axial forces; the grout within the annulus of each secondary sleeve extends to the seabed; the improvement wherein the grout within at least some of said main sleeves terminates above the seabed to decrease the axial spring value of the associated main piles and thereby increase the proportion of the axial forces which are borne by said secondary piles.

2. A jacket according to claim 1, wherein the grout in said some main piles terminates above said framing which connects said secondary sleeves to said main sleeves.

3. Apparatus according to claim 1, wherein there are eight main sleeves and four secondary sleeves.

4. In an offshore jacket of the type comprising a plurality of hollow pile sleeves resting on a seabed and projecting upwardly therefrom, and piles disposed within said sleeves and projecting downwardly therebeyond into the seabed, said piles being rigidly connected to their respective sleeves by grouting disposed within an annulus between said sleeve and said pile so that the pile resists axial forces;

the improvement wherein the lower level of the grouting within some of said annuluses terminates at relatively higher levels above the levels of grouting within others of said annuluses located closer to a center axis of said jacket to decrease the axial spring values of said piles and to more uniformly distribute the axial forces among the piles; and said some of annules, having grouting terminating at said relatively higher levels, being located within pile sleeves having a relatively greater axial loading imposed thereon than the axial loading imposed on said pile sleeves containing said other annuluses.

5. Apparatus according to claim 4, wherein said pile sleeves each include an upper end disposed generally at the water surface.

6. Apparatus according to claim 4, wherein the lower level of grout in all of said sleeves terminates above said seabed.

7. An offshore jacket structure comprising:

a plurality of hollow main pile sleeves each having a bottom end resting on a seabed and an upper end disposed generally at the water surface, a plurality of hollow secondary pile sleeves connected by framing to lower ends of said main pile sleeves and each having a bottom end resting on the seabed and an upper end terminating substantially below the water surface, said framing being characterized by a limited amount of flexibility permitting relative movement of said main sleeves relative to said secondary sleeves in response to axial loading of said main sleeves, a plurality of secondary piles disposed in said secondary sleeves and projecting downwardly therebeyond into the seabed, said secondary piles each being connected to an associated secondary sleeve by grout disposed within an annulus between said secondary sleeve and its associated secondary pile, said grout extending downwardly substantially to said seabed, and a plurality of main piles disposed in said main pile sleeves and projecting downwardly therebeyond into said seabed, said main piles each being connected to an associated main sleeve by grout disposed in an annulus between said main sleeve and its associated main pile, the grout connecting at least some of said main piles terminating above the seabed to decrease the axial spring values of the associated piles and thereby enable said some main sleeves to be displaced relative to said secondary sleeves by an amount sufficient to substantially fully flex said framing and maximize the transfer of axial loading to said secondary piles.

8. Apparatus according to claim 7, wherein there are eight main sleeves and four secondary sleeves.

9. A method of grouting the anchoring piles of an offshore jacket to more uniformly distribute axial loading therebetween, said jacket being of the type comprising a plurality of hollow main pile sleeves resting on the seabed, a plurality of hollow secondary pile sleeves of shorter height than said main sleeves and connected thereto by framing and resting on the seabed, a plurality of main piles disposed in said main sleeves and projecting downwardly therebeyond into the seabed, and a plurality of secondary piles disposed in said secondary sleeves and projecting downwardly therebeyond into the seabed, said method comprising the steps of:

introducing grout into an annulus formed between each secondary pile and its associated secondary sleeve, such that the grout extends to the seabed, introducing grout into an annulus formed between each main pile and its associated main sleeve, terminating the lower level of grout in at least some of said main sleeves at a level above the seabed to increase the axial spring value thereof and thereby decrease the proportion of axial forces which are borne by said secondary piles.

10. A method according to claim 9, wherein the lower level of grout in said some main sleeves is terminated above the level of said framing interconnecting said secondary and main sleeves.

11. A method of grouting the anchoring piles of an offshore jacket to more uniformly distribute axial loading therebetween, said jacket being of the type comprising a plurality of hollow pile sleeves resting on the seabed, with anchoring piles disposed therein and projecting downwardly therebeyond into the seabed, said method comprising the steps of introducing grout into an annulus formed between each pile and its associated sleeve, and terminating the lower level of grout in some of said annules at relatively higher levels above the levels of grout in others of said annuluses located closer to a center axis of said jacket to decrease the axial spring values of said some piles and to more uniformly distribute axial forces to be borne by said piles; and said some of annules, having grouting terminating at said relatively higher levels, being located within pile sleeves having a relatively greater axial loading imposed thereon than the axial loading imposed on said pile sleeves containing said other annuluses.

12. A method according to claim 11, wherein said terminating step includes positioning grout seals within said some sleeves at predetermined distances above the seabed to block travel of grout downwardly therebeyond.

* * * * *